US007008353B2

(12) United States Patent
Haeffer

(10) Patent No.: US 7,008,353 B2
(45) Date of Patent: Mar. 7, 2006

(54) MARTIAL ARTS, BOXING AND PERSONAL TRAINING DEVICE

(76) Inventor: Edward Haeffer, 222 W. First St., West Islip, NY (US) 11795

( * ) Notice: Subject to any disclaimer, the term of this patent is extended or adjusted under 35 U.S.C. 154(b) by 0 days.

(21) Appl. No.: 10/858,647

(22) Filed: Jun. 2, 2004

(65) Prior Publication Data

US 2005/0272569 A1 Dec. 8, 2005

(51) Int. Cl.
*A63B 69/34* (2006.01)

(52) U.S. Cl. ..... 482/83; 482/85; 482/87; 482/90

(58) Field of Classification Search ..... 482/83–90
See application file for complete search history.

(56) References Cited

U.S. PATENT DOCUMENTS

| | | | | |
|---|---|---|---|---|
| 67,310 A | | 7/1867 | Jadwin | |
| 444,420 A | | 1/1891 | Chandler | |
| 1,991,087 A | | 2/1935 | Falcon | |
| 3,917,231 A | * | 11/1975 | Fink | 256/64 |
| 5,205,799 A | * | 4/1993 | Carbonero | 482/16 |
| 5,352,170 A | * | 10/1994 | Condo et al. | 482/83 |
| 5,690,597 A | * | 11/1997 | Enfaradi | 482/126 |
| 5,735,775 A | | 4/1998 | Miasserian | |
| 5,888,179 A | * | 3/1999 | Singhal | 482/81 |
| 6,348,028 B1 | * | 2/2002 | Cragg | 482/148 |
| 6,585,625 B1 | * | 7/2003 | Ferguson | 482/83 |
| 6,790,167 B1 | * | 9/2004 | Carlin et al. | 482/90 |
| 2003/0148860 A1 | * | 8/2003 | Wren | 482/83 |

* cited by examiner

*Primary Examiner*—Gregory L. Huson
*Assistant Examiner*—L. Amerson
(74) *Attorney, Agent, or Firm*—Collard & Roe, P.C.

(57) ABSTRACT

A martial arts training device comprising a stand having a base and at least one substantially vertically extending arm extending up from the base. There is also at least one guide coupled to the stand which is for guiding a user in performing exercises. In addition, to stabilize the stand there is a stabilizer for stabilizing against movement so that when a user accidentally contacts the guide, the stand remains substantially in place. The guide can be in the form of a rope, cord, or cable.

19 Claims, 5 Drawing Sheets

MARTIAL ARTS, BOXING AND PERSONAL TRAINING DEVICE

BACKGROUND OF THE INVENTION

Field of the Invention

The present invention relates to a martial arts training device that can be used to help people train a particular movement. Other references which may be related to this field are known, such as U.S. Pat. No. 5,205,799 to Carbonero; U.S. Pat. No. 67,310 to Jadwin; U.S. Pat. No. 1,991,087 to Falcon; U.S. Pat. No. 3,917,231 to Fink; U.S. Pat. No. 5,735,775 to Miasserian; U.S. Pat. No. 5,888,179 to Singhal; and U.S. Pat. No. 444,420 to Chandler, wherein the disclosures of which are hereby incorporated herein by reference.

SUMMARY OF THE INVENTION

The invention relates to a martial arts training device comprising a stand comprising a base and at least one substantially vertically extending arm extending up from the base. There is also at least one guide coupled to the stand which is for guiding a user in performing exercises. In addition, to stabilize the stand, there is a stabilizer for stabilizing against movement so that when a user accidentally contacts the guide, the stand remains substantially in place.

This stabilizer can be in the form of a strap coupling the substantially vertically extending arm to an adjacent fixed object. In addition, this stabilizer further includes at least one water tank disposed in the base, wherein the water tank is designed to receive water to increase a weight of the base to stabilize the stand.

In addition, the vertically extending arm can comprise at least two arms which are coupled to each other in a telescoping manner, and at least one coupling element for allowing at least one of these two arms to move vertically in relation to the other and to be selectively locked in place at a desired height.

In addition, as another optional feature, at least one of the at least two telescoping arms further comprises a set of indicia to help a user determine the height at which the arms extend.

Another optional feature is least one hinge coupling the vertically extending arm to base. This hinge allows the vertically extending arm to rotate to at least a vertically upright position and to at least one folded down position.

An alternative form of the stabilizer can be a shaft which extends up from the base, wherein the shaft is for receiving weights having a hollow center. Thus, when these weights are placed on the shaft, the weights stabilize the base in place.

Another optional feature is a laterally extending arm coupled to the vertically extending arm. In this case, the guide extends along the laterally extending arm so that the guide is spaced apart from the substantially vertically extending arm.

This laterally extending arm is coupled to a top end of the vertically extending arm and can further comprise a hinge. This hinge is for rotatably coupling the laterally extending arm to the vertically extending arm.

In addition, an additional laterally extending arm can be coupled to the vertically extending arm wherein there is also at least one hinge with at least a first hinge for coupling at least one of the laterally extending arms to the vertically extending arm, and wherein the second hinge is for coupling at least one additional laterally extending arm to the substantially vertically extending arm.

The guide, which can be in the form of a cord, cable or rope, is disposed in the base optionally on a spool wherein this spool is spring loaded to selectively retract the guide into the base when the guide is not in use. In addition, there can also be a brace coupled to the vertically extending arm, wherein this brace is also coupled to the optional strap. This brace is used to help the strap support the substantially vertically extending arm.

This device can offer many advantages. For example, it be conveniently set in place and supported by other stationary objects, the guides can be adjusted in height or in lateral spacing from the vertical arm by rotating and then setting the lateral arms. In addition, the guides such as ropes or cords can also be recoiled back into the stand so that the guides can be stored away when not in use.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
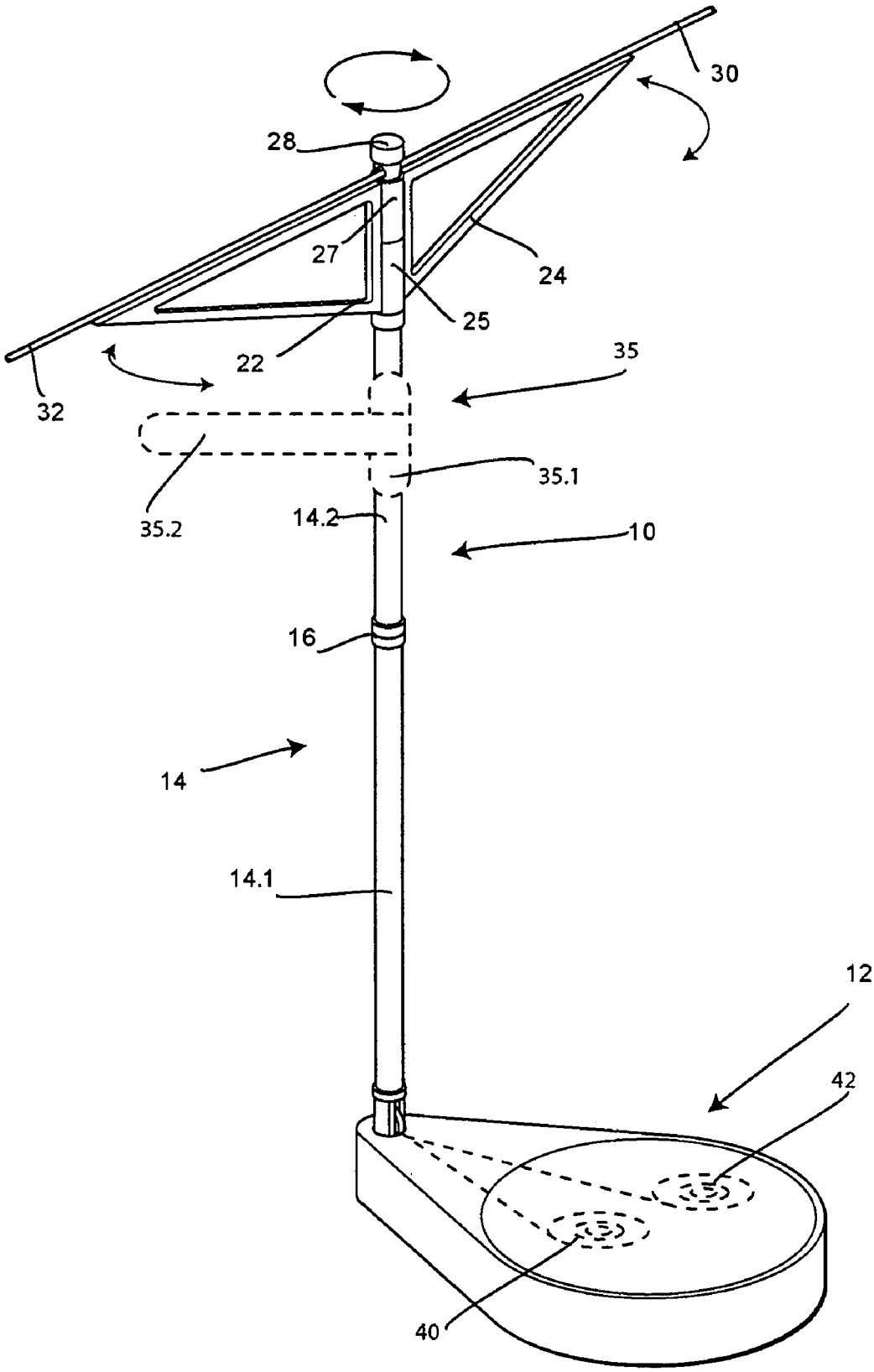
FIG. 1 discloses a side perspective view of an embodiment of the invention.

Turning now in detail to the drawings, FIG. 1 shows a side perspective view of a first embodiment of the invention. In this view, this embodiment of the device 10 includes a stand 12, which includes a base 14 and a vertically extending arm or shaft 14. Shaft 14 can be essentially a telescoping shaft that comprises at least two poles 14.1 and 14.2. In this case, shaft 14 also contains an adjuster 16 which is in the form of a twisting lock. Twisting lock 16 can be rotated to allow top pole 14.2 to slide up and out from bottom pole 14.1. Top pole 14.2 extends up from lock 16 to an upper region 20 where a set of lateral extending arms 22 and 24 extend out therefrom. In this case, top pole 14.2 can slide down into bottom pole 14.1 up to a region where lateral arms 22 and 24 extend out therefrom.

Lateral extending arms 22 and 24 are coupled to top pole 14.2 via a hinge coupling such that lateral extending arms 22 and 24 are rotatably mounted on top pole 14.2. In this case, arm 22 is coupled to top pole via hinge 25 while arm 24 is coupled to top pole 14.2 via hinge 27.

A cap 28 is also disposed on top of top pole 14.2 wherein cap 28 is used to lock hinges 25 and 27 to top pole 14.2.

Thus, lateral arms 22 and 24 can swing out or in from different radial positions to create different levels of lateral extension from pole 14.2.

Disposed inside of base 12 and also extending up and out from shafts or poles 14.1 and 14.2 are a plurality of guides 30 and 32 which are in the form of at least one rope, cord, cable or line. These guides 30 and 32 are coiled up in base 12 and can be extended out from poles 14.1 and 14.2 and guided away from stand 12 via extending arms 22 and 24 respectively. In this case, guide 30 extends out from arm 22 and guide 32 extends out from arm 24.

Essentially, only one guide is needed but two or more guides 30 and 32 can be used so that there can be either one spool or two spools 40 and 42 disposed in base 12. Spools 40 and 42 can be spring loaded so that the guides will retract into the base for easier transport.

The spring loading of the guides is also important to provide a sufficient amount of rigidity in the line so that the unspooled line does not sag or remain limp but is instead taut and forms a generally straight line across a ring while still allowing a sufficient amount of flexibility if a user bumps into the line. This guide can also be selectively locked in place in relation to stand 12 such that the guide cannot extend any further out from stand R.

Figure 2:
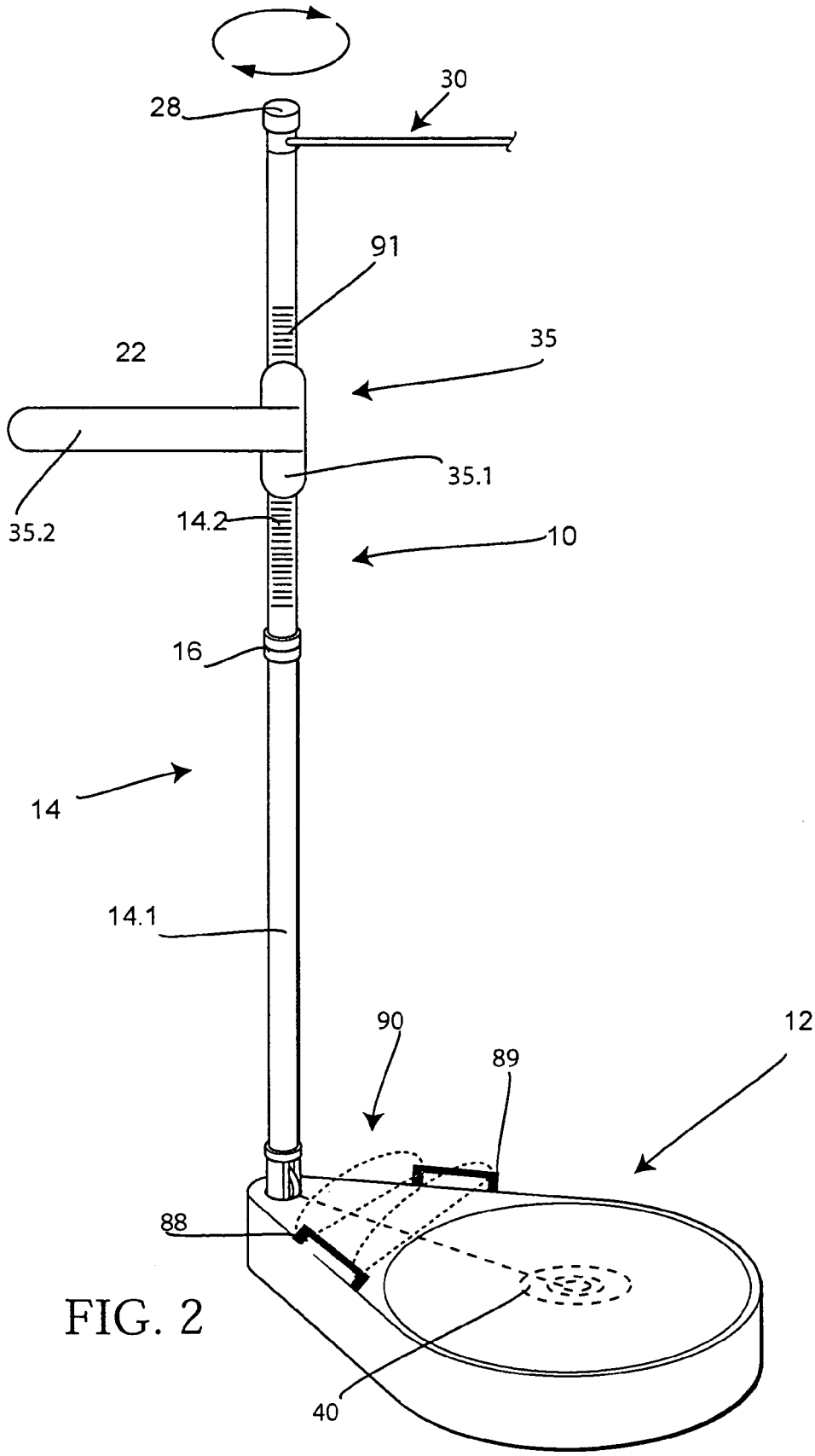
FIG. 2 shows a side perspective view of a second embodiment of the invention.

FIG. 2 shows a second embodiment of the invention wherein this device 11 shows a stand 12 with a vertical pole 14 including telescoping poles 14.1 and 14.2 which telescope in coupling 16 and extend up to endcap 28. There is also shown a strap 35 which includes a brace 35.1 and a strap element 35.2 which is coupled to brace 35.1. A single guide 30 extends up to endcap 28 and out of pole 14 from a spindle or spool 40 disposed in base 12. One of the differences between this embodiment and the embodiment shown in FIG. 1 is that this embodiment does not disclose rotatable arms 22 and 24 or a second guide 32. In this respect, this embodiment is a simplified version as compared to the embodiment shown in FIG. 1. In this view there is also shown a plurality of brackets 88 and 89 which are coupled to the base. In this case brackets 88 and 89 are for receiving an optional strap 90 such as a strap that can be slid in through brackets 88 and 89 and then fastened using a hook and loop fastener or any other type fastener for securing this strap. Strap 90 can then be used to allow a user to carry this device to other locations.

In this view there are also shown markings 91 which can be used to designate a height at which top pole 14.2 extends out from bottom pole 14.1. In this way top pole can be set at a height that allows a user to set the device in a manner that is most effective for training.

Figure 3:
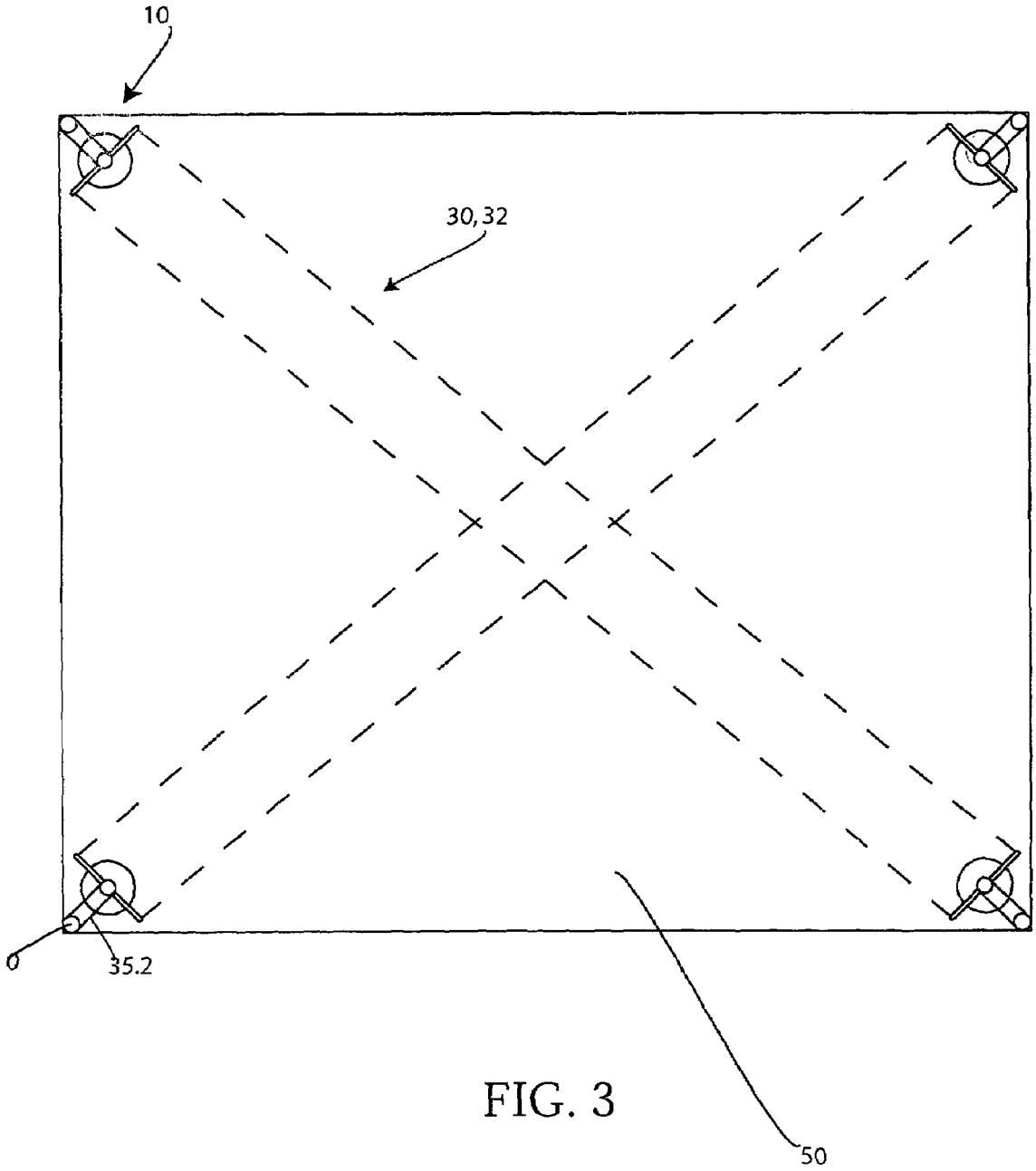
FIG. 3 shows a top view of the first embodiment of the invention in use.

FIG. 3 shows a top view of the embodiment shown in FIG. 1 disposed inside of a ring such as a boxing ring 50. In this case, the device 10 includes a plurality of straps 35.2, which extend out and wrap around a turnbuckle. These straps are used to stabilize a top end of the device so that it can be used to keep the line or guide 30 or 32 taut or level as it extends across the ring.

In this case, the device can be used so that only one guide 30 or 32 from each one of the devices 10 is extended from one arm across the ring. This guide or rope is then attached to an opposite laterally extending arm disposed in an opposite corner of the ring. The ropes or guides can be tied off on the opposite spaced poles so that when these poles are tied off, the device has two lines disposed on either side for balancing the stand.

Figure 4A:
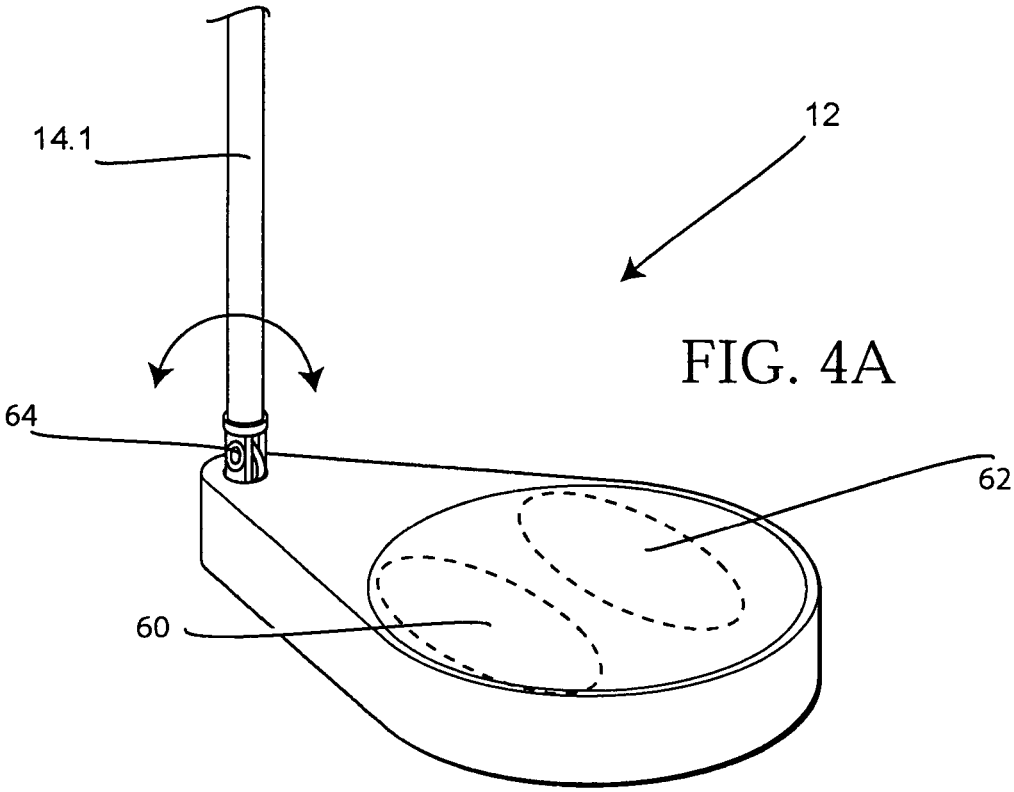
FIG. 4A shows another embodiment of the stand.
Figure 4B:
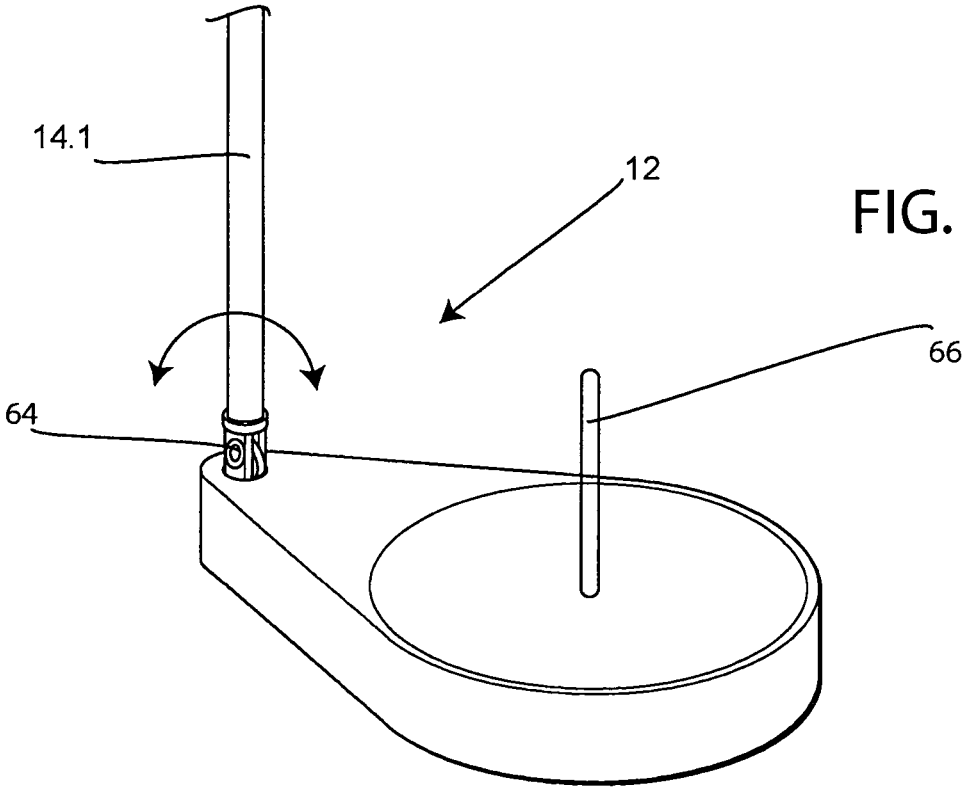
FIG. 4B shows an another embodiment of the stand.

FIGS. 4A and 4B show two different embodiments of a stand that can be used to support these ropes. For example, FIG. 4A discloses a stand that has at least one but preferably a plurality of tanks 60 and 62 which can be used to hold a fluid such as water to stabilize stand 12. When tanks 60 and 62 are filled, it provides additional weight to stabilize stand 12 in place so that it would be less likely to tip over. In addition, this view also shows that stand 12 can have an optional hinge coupling pole 14.1 to stand 12 so that pole 14 can be folded down and the device can then be placed in storage.

FIG. 4B shows a second embodiment of stand 12 wherein in this embodiment there is a shaft 66 which extends out from stand 12. Shaft 66 is used to receive weights which have a center hole and can then fit over shaft 66. In this case, the weights are placed on stand 12 to add additional weight to the stand to stabilize stand 12. This view also shows that stand 12 has hinge 64 in place as well.

Figure 5:
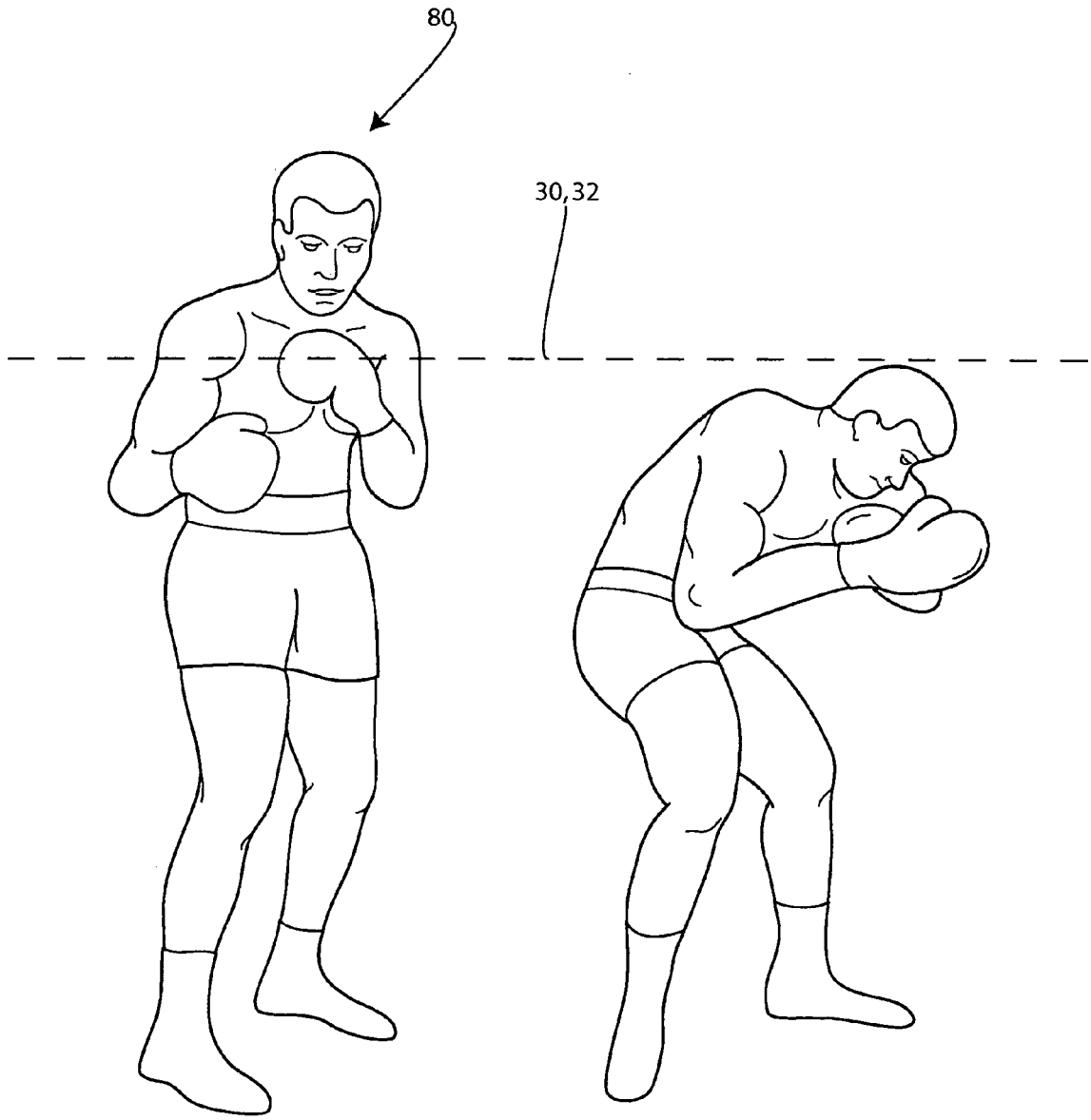
FIG. 5 shows a side view of a user using the device.

FIG. 5 shows the device in use wherein a boxer is shown ducking under guides 30, 32 to practice the necessary movements for training in martial arts.

In any one of the above described or shown embodiments, pulleys or other rope or cord conveying means may be used or incorporated therein to the device. The use of pulleys are well known in the art. For example, pulleys can be disposed in a region at a base or bottom end of coupling pole 14.1 or at an opposite end adjacent to top end 28. Pulleys may be used or disposed at lateral outside ends of lateral arms 22 and 24.

Accordingly, while a few embodiments of the present invention have been shown and described, it is to be understood that many changes and modifications may be made thereunto without departing from the spirit and scope of the invention as defined in the appended claims.

What is claimed is:

1. A martial arts training device comprising:

a) a stand comprising:

i) a base;

ii) at least one substantially vertically extending arm extending up from said base;

b) at least one flexible elongated guide coupled to said stand wherein said at least one guide is for guiding a user in performing exercises; and c) a stabilizer for stabilizing said stand against movement so that when a user accidentally contacts said guide, said stand remains substantially in place.

2. The training device as in claim 1, wherein said stabilizer is in the form of a strap coupling said substantially vertically extending arm to an adjacent fixed object.

3. The training device as in claim 1, wherein said stabilizer includes at least one water tank disposed in said base, wherein when said water tank is designed to receive water to increase a weight of said base to stabilize said stand.

4. The training device as in claim 1, wherein said at least one substantially vertically extending arm comprises at least two arms which are coupled to each other in a telescoping manner, and at least one coupling element for allowing at least one of said at least two arms to move vertically in relation to the other and to be selectively locked in place at a desired height.

5. The training device as in claim 4, wherein at least one of said at least two telescoping arms further comprises a set of indicia to help a user determine the height at which the arms extend.

6. The training device as in claim 1, further comprising at least one hinge coupled to said at least one substantially vertically extending arm and to said base, said hinge allowing said vertically extending arm to rotate to at least a vertically upright position and to at least one folded down position.

7. The device as in claim 1, wherein said stabilizer includes a shaft which extends up from said base, wherein said shaft is for receiving weights having a hollow center, wherein when said weights are placed on said shaft, said weights stabilize said base in place.

8. The device as in claim 1, further comprising at least one laterally extending arm coupled to at least one substantially said vertically extending arm, wherein said at least one flexible elongated guide extends along said at least one laterally extending arm so that said at least one flexible elongated guide is spaced apart from said at least one substantially vertically extending arm.

9. The device as in claim 8, wherein said at least one laterally extending arm is coupled to a top end of said at least one substantially vertically extending arm.

10. The device as in claim 8, further comprising a hinge wherein said hinge is for rotatably coupling said at least one laterally extending arm to said at least one substantially vertically extending arm.

11. The device as in claim 8, wherein said at least one laterally extending arm comprises at least two laterally extending arms, and the device further comprises at least two hinges with at least a first hinge for coupling at least one of said laterally extending arms to said at least one vertically extending arm, and said at least a second hinge for coupling at least one additional lateral arm to said at least one substantially vertically extending arm.

12. The device as in claim 1, wherein said guide extends out from a top region of said at least one substantially vertically extending arm.

13. The device as in claim 1, wherein at least a portion of said guide is disposed in said base on a spool wherein said spool is spring loaded to selectively retract said guide into said base when said guide is not in use.

14. The device as in claim 1, further comprising a brace coupled to said at least one substantially vertically extending arm, wherein said brace is also coupled to said strap, wherein said brace is used to help said strap support said at least one substantially vertically extending arm.

15. A device for training martial artists comprising:

a) a stand comprising:

i) a base;

ii) at least one vertical adjusting means extending up from said base for adjusting a height of said stand;

b) at least one guide means in the form of a rope coupled to said stand wherein said at least one guide means is for guiding a user in performing exercises; and c) a stabilizing means for stabilizing said stand against movement so that when a user accidentally contacts said guide, said stand remains substantially in place.

16. The device as in claim 1, wherein said flexible elongated guide is in the form of a rope.

17. The device as in claim 1, wherein said flexible elongated guide is in the form of a cable.

18. The device as in claim 1, wherein said flexible elongated guide is in the form of a line.

19. A martial arts training device comprising:

a) a stand comprising:

i) a base;

ii) at least one substantially vertically extending arm extending up from said base;

b) at least one guide coupled to said stand wherein said at least one guide is for guiding a user in performing exercises; and c) a stabilizer for stabilizing said stand against movement so that when a user accidentally contacts said guide, said stand remains substantially in place; and d) a spring loaded spool disposed in said stand, wherein at least a portion of said guide is coupled to said spring loaded spool, and wherein said spool is spring loaded to selectively retract said guide into said base when said guide is not in use.

* * * * *